US012571175B2

(12) United States Patent
Frey et al.

(10) Patent No.: US 12,571,175 B2
(45) Date of Patent: Mar. 10, 2026

(54) CUTTING EDGE SYSTEMS FOR SNOWPLOW MOLDBOARDS

(71) Applicant: 1708828 ONTARIO Ltd., Listowel (CA)

(72) Inventors: Ryan Frey, Listowel (CA); Richard Grove, Drayton (CA); Marvin Martin, Wellesley (CA); Leon Martin, Millersburg, OH (US)

(73) Assignee: 1708828 Ontario Ltd., Listowel (CA)

( * ) Notice: Subject to any disclaimer, the term of this patent is extended or adjusted under 35 U.S.C. 154(b) by 779 days.

(21) Appl. No.: 17/895,712

(22) Filed: Aug. 25, 2022

(65) Prior Publication Data

US 2023/0068800 A1 Mar. 2, 2023

Related U.S. Application Data

(60) Provisional application No. 63/238,664, filed on Aug. 30, 2021.

(30) Foreign Application Priority Data

Aug. 30, 2021 (CA) ..... CA 3129389

(51) Int. Cl.
*E01H 5/06* (2006.01)

(52) U.S. Cl.
CPC ..... *E01H 5/062* (2013.01); *E01H 5/066* (2013.01)

(58) Field of Classification Search
CPC ..... E01H 5/062; E01H 5/066; E01H 5/061; E01H 5/063; E01H 5/06; E02F 3/8152
See application file for complete search history.

(56) References Cited

U.S. PATENT DOCUMENTS

| | | | |
|---|---|---|---|
| 520,479 | A | 5/1894 | Bunnell |
| 2,698,744 | A | 1/1955 | Holthouse, Jr. et al. |
| 2,778,129 | A | 1/1957 | Freyer |
| 3,798,805 | A | 3/1974 | Hancock |

(Continued)

FOREIGN PATENT DOCUMENTS

| | | |
|---|---|---|
| CA | 2423830 | 2/2004 |
| CA | 2717986 | 9/2009 |

(Continued)

OTHER PUBLICATIONS

CTC & Associates LLC, "Clear Roads: Multipl-Blade Snowplow Project Final Report" Dec. 30, 2010.

(Continued)

*Primary Examiner* — Christopher J Sebesta
*Assistant Examiner* — Blake E Scoville
(74) *Attorney, Agent, or Firm* — Smart & Biggar LP

(57) ABSTRACT

Snowplow blades and cutting edge systems for snowplow blades are described herein. The cutting edge systems include a backing plate coupled to a bottom portion of a moldboard of the snowplow blade and a plurality of cutting edge segments each configured to be slidably mounted to the front surface of the backing plate. The backing plate has, for each of the blade segments, a central opening, a first slot positioned on a first side of the central opening and a second slot positioned on a second side of the central opening. Each cutting edge segment includes a blade segment, a compression member and a retainer plate.

20 Claims, 7 Drawing Sheets

(56) References Cited

U.S. PATENT DOCUMENTS

| | | | | |
|---|---|---|---|---|
| 3,994,081 | A | 11/1976 | Middleton | |
| 4,288,932 | A | 9/1981 | Kuper | |
| 4,635,387 | A | 1/1987 | Haring | |
| 4,669,205 | A * | 6/1987 | Smathers | E01H 5/063 37/232 |
| 4,794,710 | A | 1/1989 | Haring | |
| 5,437,113 | A | 8/1995 | Jones | |
| 5,697,172 | A | 12/1997 | Verseef | |
| 5,743,032 | A | 4/1998 | Vauhkonen | |
| 5,746,017 | A | 5/1998 | Marvick | |
| 5,819,443 | A | 10/1998 | Winter | |
| 6,073,371 | A | 6/2000 | Goos et al. | |
| 6,125,559 | A | 10/2000 | Mullenhour | |
| 6,618,965 | B1 | 9/2003 | Schultz et al. | |
| 6,701,646 | B2 | 3/2004 | Schultz et al. | |
| 6,823,615 | B2 | 11/2004 | Strait | |
| 6,922,924 | B2 | 8/2005 | Jones et al. | |
| 7,107,709 | B2 | 9/2006 | Hamel | |
| 7,143,531 | B2 | 12/2006 | Micozzi | |
| 7,159,344 | B2 | 1/2007 | Karhi | |
| 7,171,770 | B2 | 2/2007 | Schultz et al. | |
| 7,467,485 | B2 | 12/2008 | Lachance et al. | |
| 7,555,853 | B2 | 7/2009 | Paonessa | |
| 7,631,441 | B2 | 12/2009 | Hunt | |
| 7,975,407 | B2 | 7/2011 | Paonessa | |
| 8,191,287 | B2 | 6/2012 | Winter et al. | |
| 8,602,122 | B2 | 12/2013 | Congdon et al. | |
| 8,776,405 | B2 | 7/2014 | Paonessa | |
| 9,121,151 | B2 * | 9/2015 | Bergeron | E01H 5/06 |
| D781,352 | S | 3/2017 | Hunt | |
| 9,611,604 | B2 | 4/2017 | Vigneault | |
| 2003/0182824 | A1 | 10/2003 | Coffin et al. | |
| 2004/0231201 | A1 | 11/2004 | Hamel | |
| 2009/0282706 | A1 | 11/2009 | Barker et al. | |
| 2011/0314708 | A1 | 12/2011 | Paonessa | |
| 2013/0037287 | A1 | 2/2013 | Hall | |
| 2016/0040379 | A1 | 2/2016 | Vigneault | |
| 2017/0218585 | A1 * | 8/2017 | Vigneault | E01H 5/062 |
| 2019/0136473 | A1 * | 5/2019 | Desrochers | E01H 5/061 |
| 2019/0136474 | A1 * | 5/2019 | Martin | E01H 5/062 |
| 2019/0203436 | A1 * | 7/2019 | Martin | E01H 5/066 |

FOREIGN PATENT DOCUMENTS

| | | | | |
|---|---|---|---|---|
| CA | 2723630 | A1 * | 6/2012 | E01H 5/062 |
| CA | 2625016 | | 5/2013 | |
| CA | 2796157 | | 8/2013 | |
| CA | 2856940 | | 7/2017 | |
| DE | 1299675 | | 7/1969 | |
| DE | 3205974 | | 9/1983 | |
| EP | 1557494 | | 7/2007 | |
| EP | 2271807 | | 8/2017 | |
| GB | 886572 | | 1/1960 | |
| WO | WO-2017152264 | A1 * | 9/2017 | E01H 5/061 |

OTHER PUBLICATIONS

Henderson Manufacturing Inc., "RSP Reversible Plow" Brochure Dec. 2017.

Bonnell Industries Inc., "High Country Tortion Trip Snow Plow" Brochure 0306 www.bonnell.com 2006.

Black Cat Blades, Joma 6000, <https://web.archive.org/web/20060513193346/http:jomablackcat.com:80/products/products.html> Jan. 10, 2006.

Arctic Incorporated Snow, Sectional Sno-Plow Apr. 1, 2009.

* cited by examiner

CUTTING EDGE SYSTEMS FOR SNOWPLOW MOLDBOARDS

RELATED APPLICATIONS

The present application claims the benefit of U.S. Provisional Patent Application No. 63/238,664 titled "Cutting Edge Systems for Snowplow Moldboards" filed 30 Aug. 2021, the entire contents of which are incorporated herein by reference.

TECHNICAL FIELD

This disclosure relates generally to snowplows, and more specifically, to cutting edge systems for snowplow moldboards.

BACKGROUND

Snowplow blades are typically mounted directly to a front of a vehicle to remove debris such as dirt, snow and/or ice from a ground surface directly in front of the vehicle when the vehicle is in motion. Factors such as the type of ground surface the blade is used on, the frequency of usage of the blade and a user's ability to operate the vehicle may cause damage to the blade that results in a need to replace part or all of the lowermost cutting edge of the plow blade.

Several different mechanisms have been developed in attempts to prevent damage to snowplow blades that is caused by the blade engaging the ground surface during use or striking an obstruction. For example, some current snowplow blades have solid upper moldboards and lower cutting edges that include individual cutting edge segments that are separately removable and replaceable. The individual cutting edge segments may also provide for the lowermost cutting edge of the plow blade to contour to uneven ground surfaces. This is generally accomplished by biasing the lowermost cutting edge of each individual cutting edge segment to engage the ground surface and then providing for each individual cutting edge segment to move vertically relative to the upper moldboard of the plow blade.

Current cutting edge systems typically include blade segments with openings therein that provide for the blade segments to follow ground contours. Unfortunately, these designs are susceptible to being obstructed and/or clogged by debris such as dirt and snow because the debris can easily pass from the outward-facing surface of the blade segment, which directly engages the dirt and snow, to the openings that provide for vertical movement of the blade segments.

Accordingly, there is a need for improved snowplows and cutting edge systems for snowplows that follow ground contours and are not obstructed or clogged by accumulation of debris such as dirt and snow.

SUMMARY

In accordance with a broad aspect, a cutting edge system for a snowplow blade is described herein. The system includes a backing plate coupled to a bottom portion of a moldboard of the snowplow blade and a plurality of cutting edge segments each configured to be slidably mounted to the front surface of the backing plate. The backing plate has, for each of the blade segments, a central opening, a first slot positioned on a first side of the central opening and a second slot positioned on a second side of the central opening. Each cutting edge segment includes a blade segment configured to be slidably mounted to the backing plate. The blade segment has a lower portion having a cutting edge configured to engage a ground surface and an upper portion having an uppermost edge opposed to the cutting edge and two upwardly extending lobes spaced apart from each other to define an intermediate pocket portion therebetween. Each of the two lobes is configured to receive a fastener to slidably mount the blade segment to the backing plate. Each cutting edge segment also includes a compression member configured to be retained in between the uppermost edge of the intermediate pocket portion and an engaging surface extending from the central opening of the backing plate. The compression member is configured to absorb upward movement of the blade segment when the cutting edge engages the ground surface. Each cutting edge segment also includes a retainer plate configured to be slidably mounted to the backing plate and cover at least a portion of the blade segment when the blade segment is mounted to the backing plate.

In at least one embodiment, the first and second slots of the backing plate are each axially aligned with respective openings of the blade segment to receive the fasteners therethrough to slidably mount the blade segment to the backing plate.

In at least one embodiment, the first and second slots of the backing plate are each axially aligned with respective openings of the retainer plate to receive the fasteners therethrough to slidably mount the retainer plate to the backing plate.

In at least one embodiment, the first and second slots of the backing plate are each axially aligned with respective openings of the blade segment and respective openings of the retainer plate to receive the fasteners therethrough to slidably mount the blade segment and the retainer plate to the backing plate.

In at least one embodiment, each of the plurality of cutting edge segments further includes at least one sleeve positioned rearwardly of the blade segment, each sleeve being configured to receive one of the fasteners.

In at least one embodiment, each sleeve is shaped to be received inside one of the slots of the backing plate and slide vertically within the slot when the blade segment moves vertically relative to the backing plate.

In at least one embodiment, the slots of the backing plate are spaced apart from each other along a width of the backing plate and each slot has a perimeter that is greater than a perimeter of a respective sleeve.

In at least one embodiment, each of the two slots has a height that is greater than a height of a respective fastener to provide for sliding, vertical movement of the blade segment relative to the backing plate when the cutting edge engages the ground surface.

In at least one embodiment, each of the two slots includes a slot extension extending downwardly from the slot, each slot extension having a width that is less than a width of the slot.

In at least one embodiment, the width if each of the slot extensions is less than a width of a sleeve that is shaped to be received inside one of the slots of the backing plate and slide vertically therein.

In at least one embodiment, the retainer plate is configured to cover the intermediate pocket portion when the blade segment is mounted to the backing plate.

In at least one embodiment, the retainer plate is configured to cover the central opening when the blade segment is mounted to the backing plate.

In at least one embodiment, the engaging surface of the backing plate is parallel to the cutting edge of the blade segment.

In at least one embodiment, the central opening has a width that is greater than a width of the compression member.

In accordance with another broad aspect, a snowplow blade is described herein. The snowplow blade includes a moldboard and a cutting edge system coupled to the moldboard. The cutting edge system includes a backing plate coupled to a bottom portion of a moldboard of the snowplow blade and a plurality of cutting edge segments each configured to be slidably mounted to the front surface of the backing plate. The backing plate has, for each of the blade segments, a central opening, a first slot positioned on a first side of the central opening and a second slot positioned on a second side of the central opening. Each cutting edge segment includes a blade segment configured to be slidably mounted to the backing plate. The blade segment has a lower portion having a cutting edge configured to engage a ground surface and an upper portion having an uppermost edge opposed to the cutting edge and two upwardly extending lobes spaced apart from each other to define an intermediate pocket portion therebetween. Each of the two lobes is configured to receive a fastener to slidably mount the blade segment to the backing plate. Each cutting edge segment also includes a compression member configured to be retained in between the uppermost edge of the intermediate pocket portion and an engaging surface extending from the central opening of the backing plate. The compression member is configured to absorb upward movement of the blade segment when the cutting edge engages the ground surface. Each cutting edge segment also includes a retainer plate configured to be slidably mounted to the backing plate and cover at least a portion of the blade segment when the blade segment is mounted to the backing plate. These and other features and advantages of the present application will become apparent from the following detailed description taken together with the accompanying drawings. It should be understood, however, that the detailed description and the specific examples, while indicating preferred embodiments of the application, are given by way of illustration only, since various changes and modifications within the spirit and scope of the application will become apparent to those skilled in the art from this detailed description.

BRIEF DESCRIPTION OF THE DRAWINGS

For a better understanding of the various embodiments described herein, and to show more clearly how these various embodiments may be carried into effect, reference will be made, by way of example, to the accompanying drawings which show at least one example embodiment, and which are now described. The drawings are not intended to limit the scope of the teachings described herein.

Figure 1:
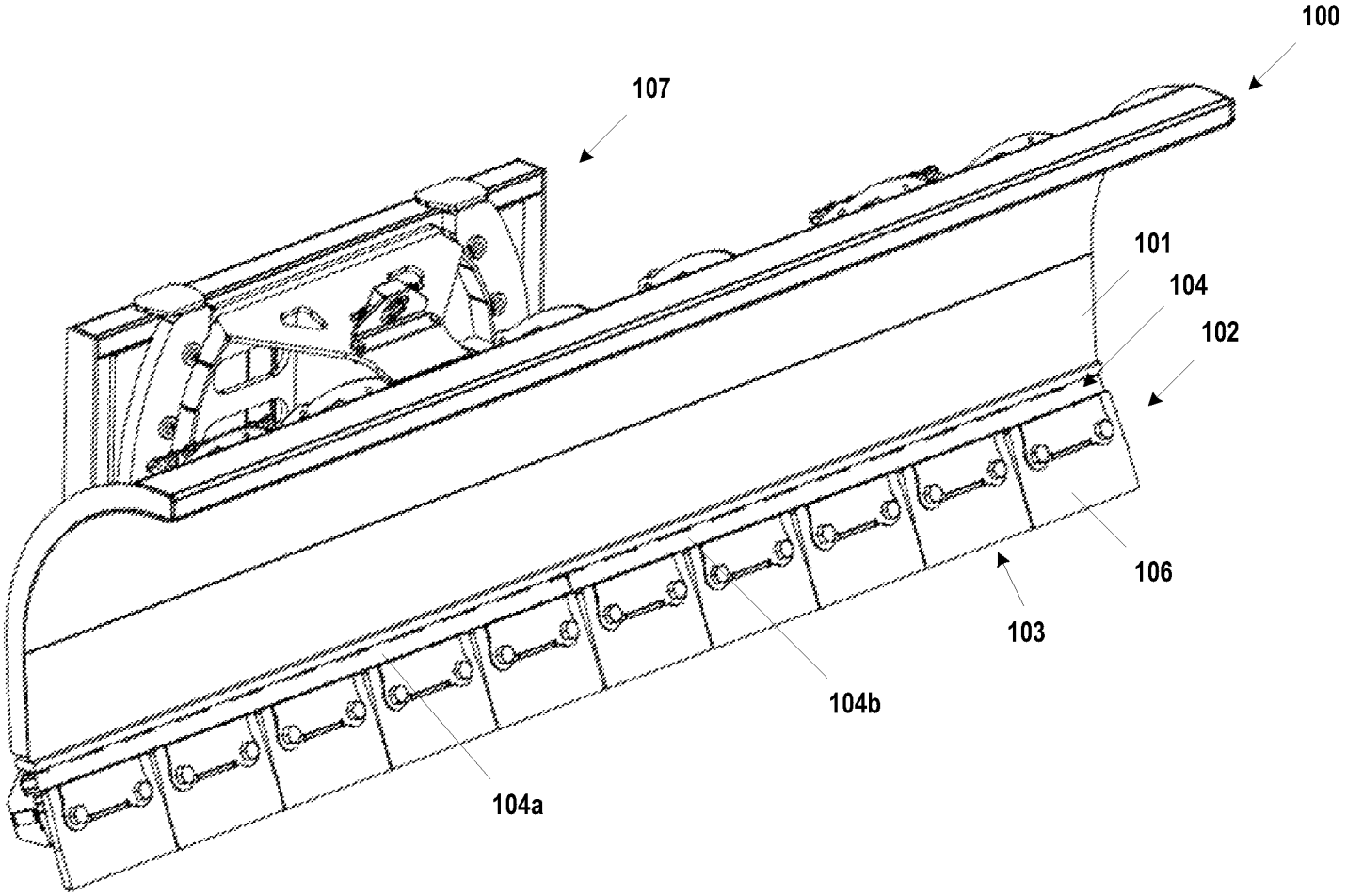
FIG. 1 is a front perspective view of a snowplow moldboard having a cutting edge system according to at least one embodiment described herein.

Further aspects and features of the example embodiments described herein will appear from the following description taken together with the accompanying drawings.

DETAILED DESCRIPTION

Various apparatuses, methods and compositions are described below to provide an example of at least one embodiment of the claimed subject matter. No embodiment described below limits any claimed subject matter and any claimed subject matter may cover apparatuses and methods that differ from those described below. The claimed subject matter is not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed subject matter. Any subject matter that is disclosed in an apparatus, method or composition described herein that is not claimed in this document may be the subject matter of another protective instrument, for example, a continuing patent application, and the applicant(s), inventor (s) and/or owner(s) do not intend to abandon, disclaim, or dedicate to the public any such invention by its disclosure in this document.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

It should be noted that terms of degree such as "substantially", "about" and "approximately" as used herein mean a reasonable amount of deviation of the modified term such that the end result is not significantly changed. These terms of degree should be construed as including a deviation of the modified term, such as 1%, 2%, 5%, or 10%, for example, if this deviation does not negate the meaning of the term it modifies.

Furthermore, the recitation of any numerical ranges by endpoints herein includes all numbers and fractions subsumed within that range (e.g. 1 to 5 includes 1, 1.5, 2, 2.75, 3, 3.90, 4, and 5). It is also to be understood that all numbers and fractions thereof are presumed to be modified by the term "about" which means a variation up to a certain amount of the number to which reference is being made, such as 1%, 2%, 5%, or 10%, for example, if the end result is not significantly changed.

It should also be noted that, as used herein, the wording "and/or" is intended to represent an inclusive—or. That is, "X and/or Y" is intended to mean X, Y or X and Y, for example. As a further example, "X, Y, and/or Z" is intended to mean X or Y or Z or any combination thereof. Also, the expression of A, B and C means various combinations including A; B; C; A and B; A and C; B and C; or A, B and C.

The following description is not intended to limit or define any claimed or as yet unclaimed subject matter. Subject matter that may be claimed may reside in any combination or sub-combination of the elements or process steps disclosed in any part of this document including its claims and figures. Accordingly, it will be appreciated by a person skilled in the art that an apparatus, system or method disclosed in accordance with the teachings herein may embody any one or more of the features contained herein and that the features may be used in any particular combination or sub-combination that is physically feasible and realizable for its intended purpose.

Referring now to FIG. 1, illustrated therein is a perspective view of a snowplow blade 100 with a cutting edge system 102, according to one embodiment. In at least one embodiment, the cutting edge system 102 is a "ground contouring" cutting edge system. The terms "ground" or "ground surface" used herein are used in a generic manner. "Ground" or "ground surface" may include, for instance, roadway surfaces made of different materials such as asphalt, concrete, stones, gravel, earth, or the like. "Ground" or "ground surfaces" may include roads for vehicles, parking lots, airport runways, sidewalks, or the like.

The snowplow blade 100 shown in FIG. 1 is a moldboard-type snowplow blade including a moldboard 101. Moldboard 101 is generally constructed of a strong, high impact material, such as steel, in order to prevent damage to the snowplow blade 100 during use.

The snowplow blade 100 shown in FIG. 1 also includes a cutting edge system 102. Cutting edge system 102 includes a plurality of independently movable cutting edge segments 103 and a backing plate 104. The plurality of cutting edge segments 103 are slidably mounted to backing plate 104. Snowplow blade 100 is generally connected to a vehicle (not shown) using a generic connection assembly, such as assembly 107.

Backing plate 104 may be a single piece or may include a plurality of independently movable portions. For example, in the embodiment shown in the drawings, backing plate 104 includes a left portion 104*a* and a right portion 104*b*. Herein, the terms "left" and "right" are used to refer to a direction relative to a person standing in front of and looking at a front surface of the snowplow blade 100.

Figure 2:
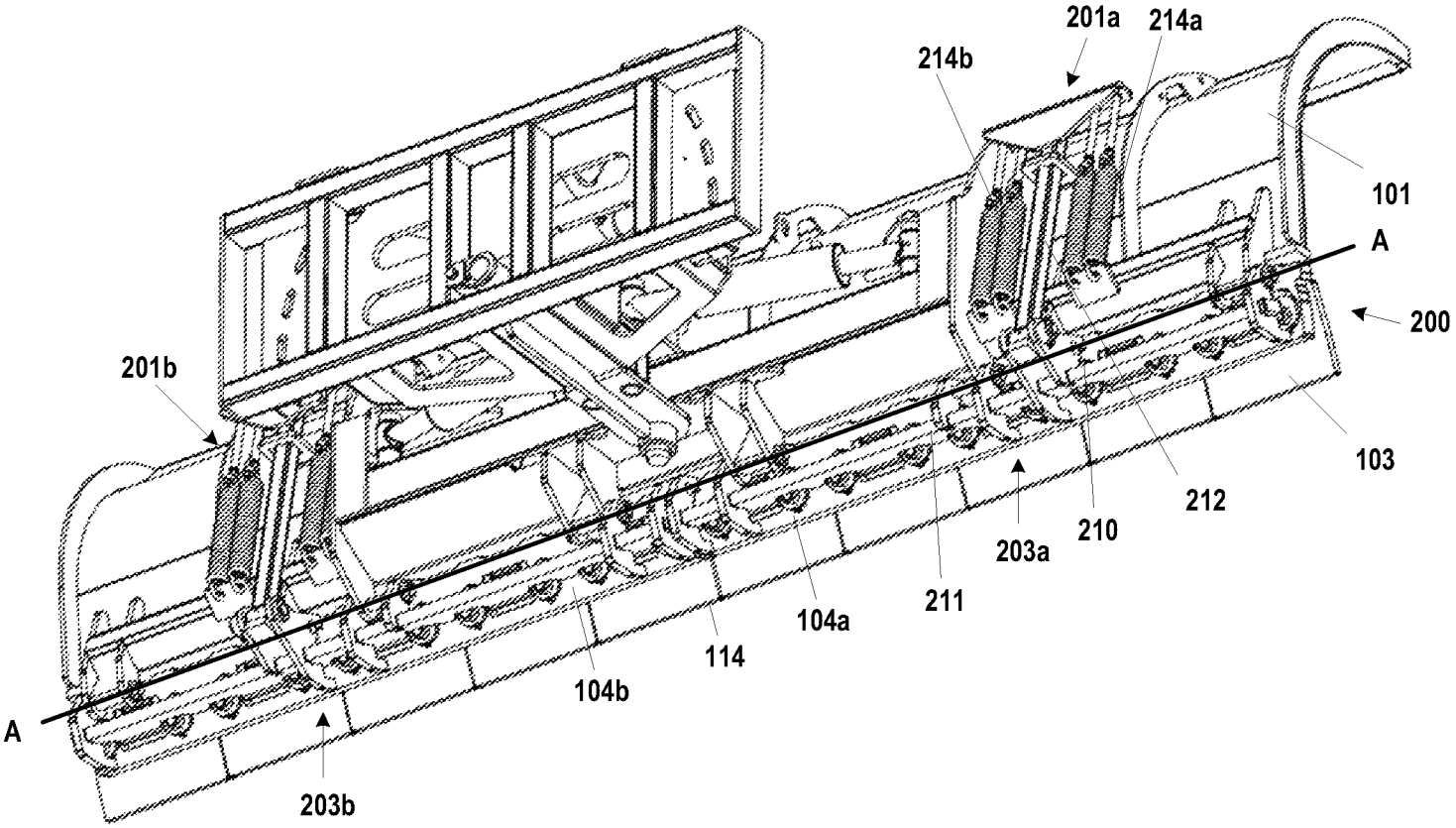
FIG. 2 is rear perspective view of the snowplow moldboard of FIG. 1.
Figure 3:
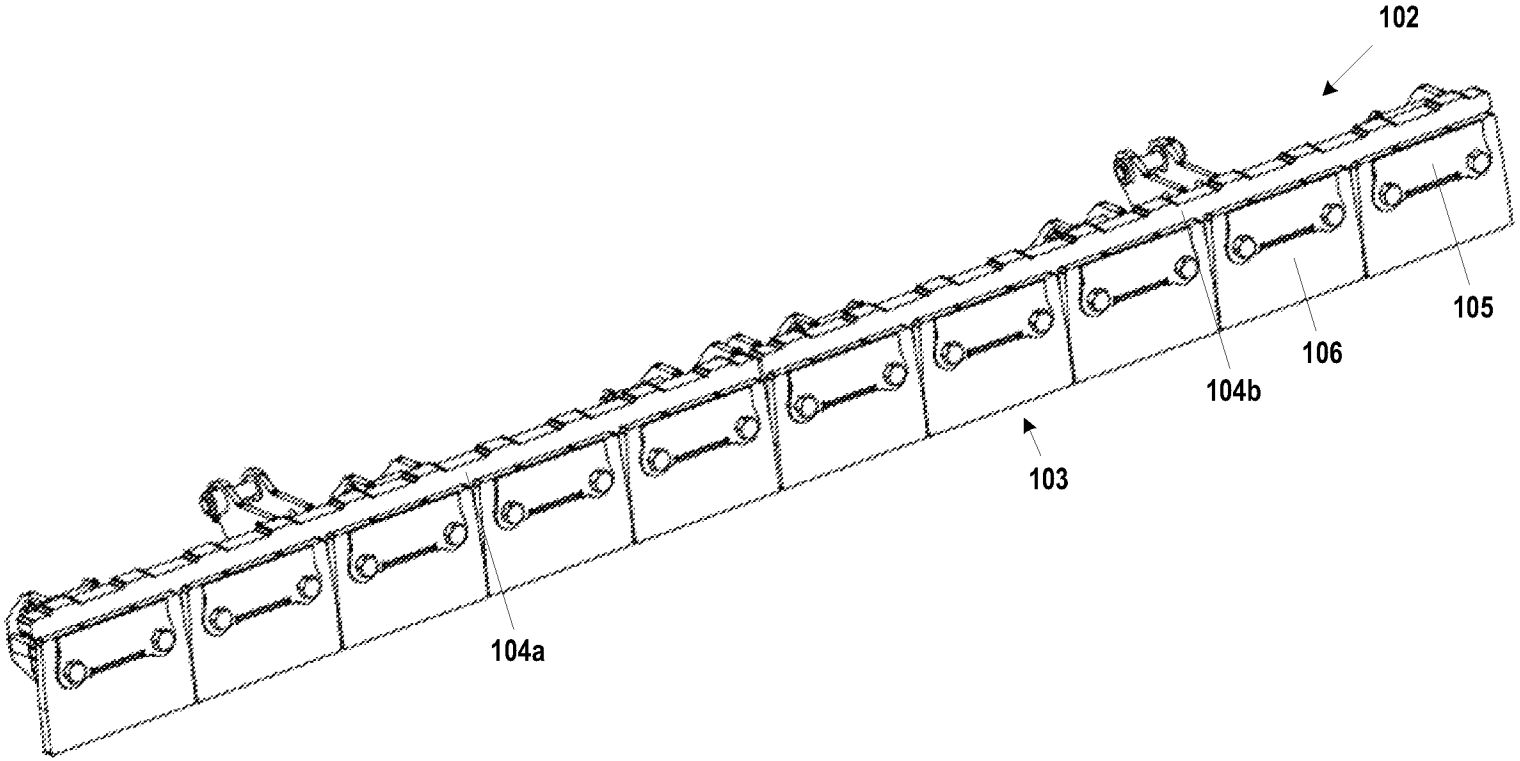
FIG. 3 is a front perspective view of a cutting edge system for a snowplow according to at least one embodiment described herein.

Left portion 104*a* and right portion 104*b* are identified in each of FIGS. 1-3. In the embodiments described herein, the left and right portions 104*a*, 104*b*, respectively, are independently movable in a rearward direction such that when the cutting edge system 102 engages an obstruction on a ground surface, the left and right portions 104*a*, 104*b* may trip (i.e. pivot) about axis AA (see FIG. 2) via trip edge mechanism 200 to enable the obstruction to pass underneath the moldboard 101 and thereby protect the snowplow blade 100 from damage.

Trip edge mechanism 200 is shown in greater detail in FIG. 2. Trip edge mechanism 200 provides for the backing plate 104 (e.g. left and right portions 104*a* and 104*b*, respectively) to pivot rearwardly relative to moldboard 101 to protect the cutting edge segments 103 from damage, particularly damage caused by the snowplow blade 100 striking a large obstruction (e.g. a manhole). In at least one embodiment, axis AA is substantially parallel to cutting edge 114 of the cutting edge segments 103.

Trip edge mechanism 200 includes one or more spring assemblies 201 for biasing at least a portion of backing plate 104 forwardly into a working (e.g. operating) position (as shown in FIGS. 1 and 2). In the embodiment shown in the Figures, snowplow blade 100 include two spring assemblies 201*a* and 201*b*. Spring assembly 201*a* is connected to right portion 104*a* of backing plate 104 and spring assembly 201*b* is connected to left portion 104*b* of backing plate 104.

Each spring assembly 201*a*, 201*b* includes one or more springs 214 secured to a portion of the moldboard 101, a trip lever 212 and a trip rod 210. In the embodiment shown in the Figures, each spring assembly 201*a*, 201*b* includes a first pair of springs 214*a* and a second pair of springs 214*b*. The pairs of springs 214*a*, 214*b* bias trip lever 212 downwardly to bias the backing plate 104 into the working position.

Trip lever 212 rotationally couples to trip rod 210 which is fixedly coupled to a trip bar 211 extending along a width of a respective trip segment 203. As snowplow blade 100 strikes an obstruction, trip assembly 201 is driven rearwardly from a working position to a non-working (e.g. non-operating) position, thereby forcing counterclockwise rotation of trip bar 211. Counterclockwise rotation of 211 provides for trip rod 210 to lift trip lever 212 vertically, which extends each pair of springs 214*a* and 214*b*. To return the trip edge 200 to the working position, a downward force is applied to the trip lever 212 by the pairs of springs 214*a* and 214*b* to rotate the trip bar 211 in a clockwise direction to and bias the trip edge 220 forward.

In the embodiment shown in the Figures, trip edge mechanism 200 includes two trip sections 203. FIG. 2 shows snowplow blade 100 including left and right trip sections 203*a* and 203*b*, respectively. Each trip section 203 includes a respective backing plate portion 104 coupled to a spring assembly 201. For example, trip section 203*a* includes backing plate portion 104*a* coupled to spring assembly 201*a* and tip section 203*b* includes backing plate portion 104*b* coupled to spring assembly 201*b*.

Spring assembly 201 provides for each trip section 203 to independently rotate about axis AA. As shown in FIG. 2, spring assembly 201*a* provides for trip section 203*a* to rotate about axis AA and spring assembly 201*b* provides for trip section 203*a* to rotate about axis AA. It should be understood that trip edge mechanism 200 may include a single trip section extending across a width of the snowplow blade or, alternatively, may include two or more trip sections.

Figure 4:
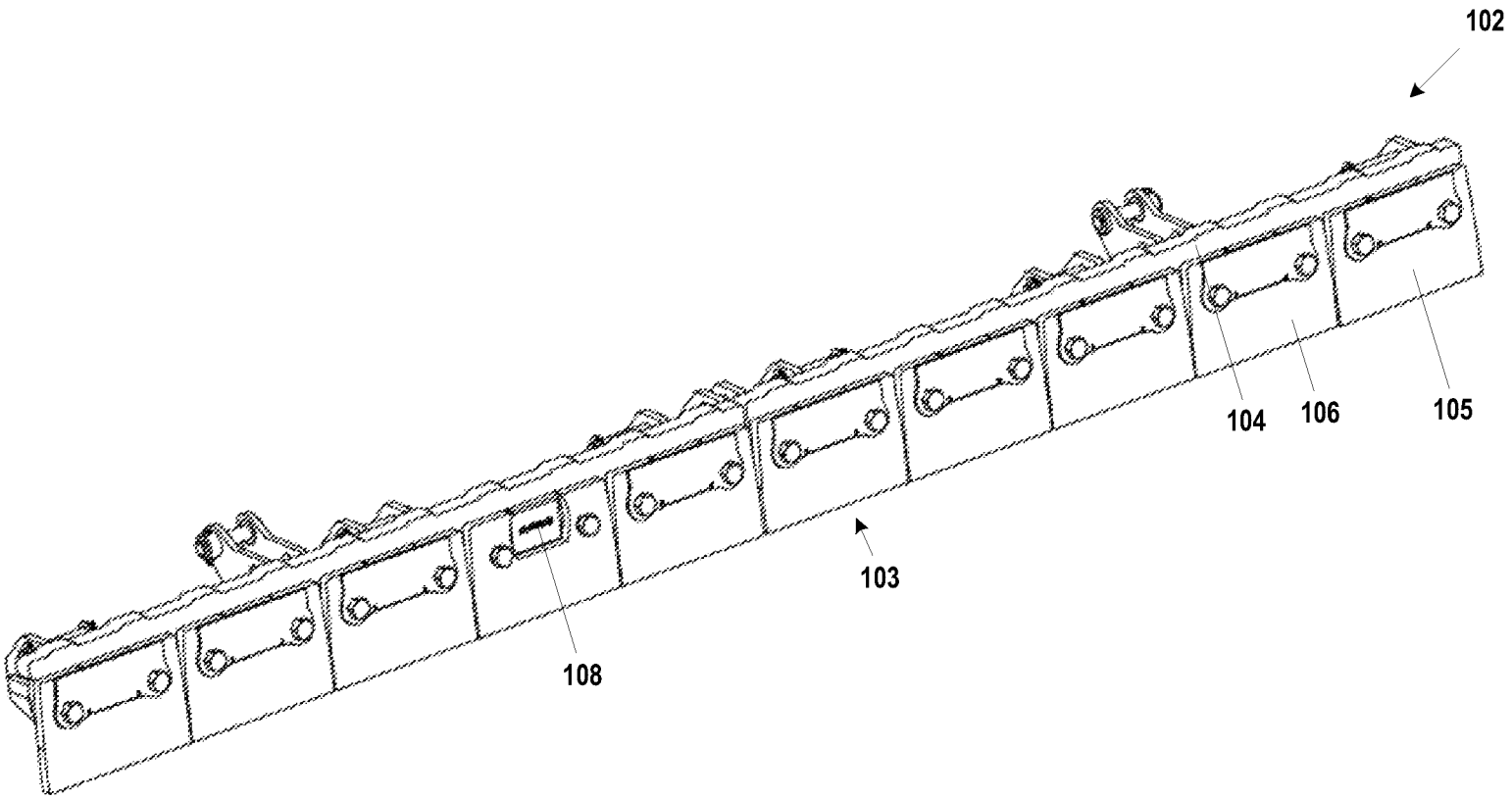
FIG. 4 is a front perspective view of the cutting edge system for a snowplow according to FIG. 3 showing one of the retainer plates being removed.

Turning now to FIG. 3, shown therein is a front perspective view of cutting edge system 102 having a plurality cutting edge segments 103. Each cutting edge segment 103 includes a retainer plate 105, a blade segment 106 and a compression member 108 (not shown in FIG. 3 because compression member 108 is positioned rearwardly of retainer plate 105, but shown in FIG. 4). FIG. 4 shows a front perspective view of cutting edge system 102 where one retainer plate 105 has been removed from one of the cutting edge segments 103 to expose the underlying compression member 108.

Figure 5:
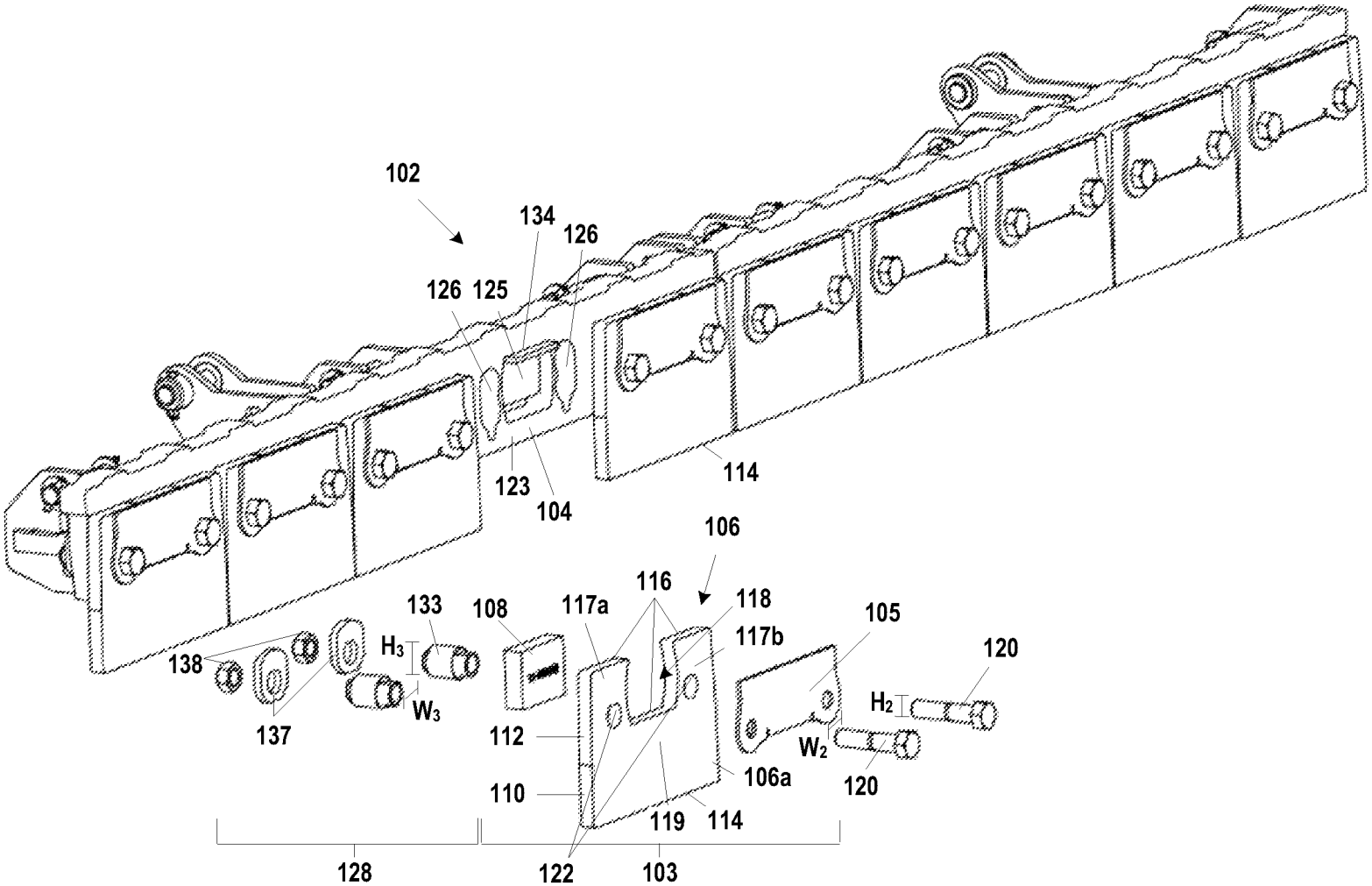
FIG. 5 is an exploded front perspective view of the cutting edge system for a snowplow according to FIG. 3 showing each of the components of the cutting edge system.

FIG. 5 shows a front perspective view of cutting edge system 102 including an exploded view of one cutting edge segment 103 of the cutting edge system 102 and an exposed portion of backing plate 104 showing where the cutting edge segment 103 shown exploded was removed.

Retainer plate 105 is typically made of a metal material and positioned on an outer surface 106*a* of the blade segment 106 to cover at least a portion of the blade segment 106 to inhibit debris from entering, for example, the pocket portion 118 of blade segment 106. Generally, retainer plate 105 is sized and shaped to cover pocket portion 118 of blade segment 106 to inhibit debris from entering pocket portion 118 and, subsequently, central opening 125 (described in greater detail below). Retainer plate 105 is also positioned on outer surface 106 of blade segment 106 to retain the compression member 108, described in greater detail below, in the pocket 118 of the blade segment 106. Retainer plate 105 includes two openings, each sized to receive a fastener 120 to slidably mount the retainer plate 105 to the backing plate 104.

Blade segment 106 includes a lower portion 110 having a lowermost (i.e. cutting) edge 114 configured to engage a ground surface, and an upper portion 112 having an uppermost edge 116 opposed to the cutting edge 114. Lower portion 110 generally extends downwardly and is exposed below the retainer plate 105 when the blade segment 106 and the retainer plate 105 are slidably mounted to backing plate 104. Similarly, upper portion 112 is generally positioned in between the retainer plate 105 and backing plate 104 when the retainer plate 105 and the blade segment 106 are slidably mounted to the backing plate 104.

Upper portion 112 of blade segment 106 has two upwardly extending lobes 117*a*, 117*b* spaced apart from each other to define a pocket 118 therebetween. Each of the two lobes 117*a*, 117*b* includes an aperture 122 configured to receive a sleeve 133, which accepts a fastener 120 to slidably mount the blade segment 106 to the backing plate 104.

Blade segment 106 also includes an intermediate portion 119 extending downwardly from the pocket 118 between lobes 117*a* and 117*b*.

FIG. 5 also shows a front surface 123 of backing plate 104. Backing plate 104 generally includes, for each cutting edge segment, a central opening 125 and two slots 126 positioned on opposed sides of the central opening 125.

Central opening 125 is positioned immediately behind the compression member 108 (described in greater detail below). Central opening 125 is sized and shaped to, in at least one embodiment, receive at least a portion of the compression member 108. In at least one embodiment, central opening 125 is sized and shaped to provide a passageway for debris (e.g. dirt, snow and the like) to travel rearwardly from the front surface 106*a* of the blade segment 106 so as to not inhibit or clog vertical movement of blade segment 106 relative to backing plate 104. For instance, central opening 125 has a width that is greater than a width the compression member 108 and a height that is greater than a height of the compression member 108. Typically, the compression member 108 is compressed vertically when the blade segment 106 moves upward as the lowermost edge 114 of blade segment 106 engages a ground surface. Compression member 108 is compressed between uppermost edge 116 of blade segment 106 and engaging surface 134 of backing plate 104. To accommodate for the width of compression member 108 increasing upon being vertically compressed, the width of central opening 125 is greater than the width of compression member 108 when compression member 108 is in its uncompressed state.

FIG. 5 also shows that slots 126 are sized and shaped to receive sleeve 133 therein and provide for sleeve 133 and fastener 120 to slide vertically relative to backing plate 104 when lowermost edge 114 of blade segment 106 engages a ground surface. In at least one embodiment, slots 126 each include a slot extension 127. Slot extension 127 has a width W4 (see FIG. 6) that is less that width W3 of sleeve 133 to inhibit sleeve 133 from entering slot extension 127. Width W4 is also less than width W1 of slot 126. By inhibiting sleeve 133 from fitting in slot extension 127, slot extensions 127 may expel debris that enters slots 126.

In at least one embodiment, an engaging surface 134 extends outwardly from the central opening 125 of backing plate 104. For example, in at least one embodiment, engaging surface 134 is an upper tab that may be integral with backing plate 104 or may be a separate component that is attached (e.g. welded) to backing plate 104. In at least one embodiment, engaging surface 134 may be welded to an upper portion of central opening 123 and extend outwardly (e.g. in a direction towards the blade segment 106) from a front surface of the backing plate 104 to register with compression member 108 (e.g. with a top edge of the compression member 108). Engaging surface 134 can therefore inhibit vertical movement of the compression member 108, and therefore also inhibit vertical movement of blade segment 106, when lowermost edge 114 of blade segment 106 engages ground contours.

Each slot 126 of backing plate 104 is shaped to receive a fastener assembly 128 that slidably mounts the retainer plate 105 to backing plate 104. Fastener assembly 128, together with slots 126 of backing plate 104, provides for the blade segment 106 to slidably mount to backing plate 104. Specifically, blade segment 106 slides vertically relative to the backing plate 104 when lowermost edge (or cutting edge) 114 of blade segment 106 engages the ground surface. Slots 126 also provide for slidingly mounting blade segment 106 to backing plate 104.

Figure 7:
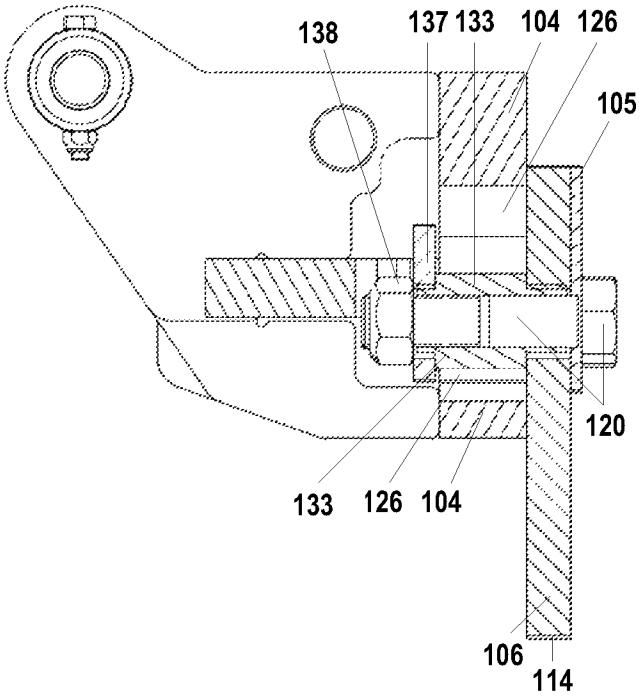
FIG. 7 is a side view of a blade segment of the cutting edge system for a snowplow according to FIG. 3.

In the embodiments shown in the drawings, fastener assembly 128 includes two fasteners 120, two sleeves 133, two washers 137 and two nuts 138. The components of the fastener assembly 128 are shown in FIG. 5 as well as FIG. 7.

Figure 6:
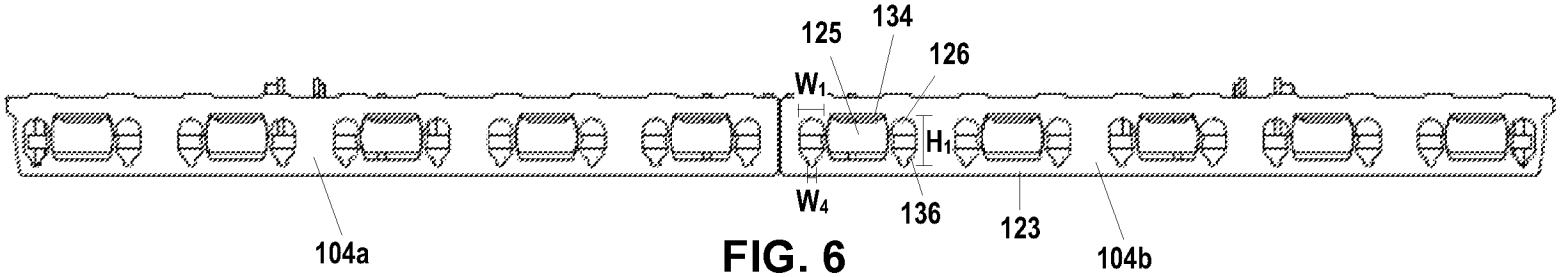
FIG. 6 is a front view of a backing plate of the cutting edge system for a snowplow according to FIG. 3.

FIG. 6 shows a front view of backing plate 104 showing slots 126. In at least one embodiment, each slot 126 is sized and shaped to receive a sleeve 133 that is received on each of the fasteners 120. Each of the two slots 126 for each respective blade segment 106 has a height $H_1$ that is greater than a height $H_3$ of its respective sleeve 133 (see FIG. 5). In at least one embodiment, one sleeve 133 is configured to surround at least a portion of each fastener 120 when fastener 120 and sleeve 133 are received in the slot 126. IN at least one embodiment, slot 126 is shaped to conform to an outer surface of at least a portion of sleeve 133 that is received in slot 126 when blade segment 106 is slidably mounted to backing plate 104.

Slots 126 of backing plate 104 have a width $W_1$ that is greater than a width $W_2$ of fastener 120 (see FIG. 5) of sleeve 133. In at least one embodiment, height $W_1$ of slot 126 is greater than width $W_3$ of sleeve 133 to provide for slight lateral movement of sleeve 133 within slot 126 as sleeve 133 slides vertically. Again, slot 126 is shaped to conform to at least a portion of the outer surface of sleeve 133 that is received in slot 126 when blade segment 106 is slidably mounted to backing plate 104.

Each slot 126 has a perimeter 136 that defines the shape of the slot 126. In some embodiments, perimeter 136 of each slot 126 of the backing plate 104 may have a generally oblong shape with rounded corners to provide for the fastener 120 and/or sleeve 133 to slide and/or pivot relative to the backing plate 104 when received in each slot 126. In at least one embodiment, perimeter 136 of slot 126 may have dimensions that resemble a different shape, including but not limited to a shape resembling two semi-circles on opposite sides of a rectangle, an oval shape, an elliptical shape, a circle, a quatrefoil, a kidney shape, a peanut shape or the like.

Each fastener 120 may be a bolt, screw or the like that passes through the openings of the retainer plate 105, the openings of the blade segment 106 and, together with sleeve 133, through the slots 126 of backing plate 104, to couple to the backing plate 104. In at least one embodiment, each fastener 120 may be a retaining member that is integral with the backing plate 104 and protrude outwardly from a front face of the backing plate 104.

Each sleeve 133 generally surrounds a respective fastener 120 and is shaped to be slightly smaller than the width W1 of slot 126 to allow blade segment 106, sleeve 133 and fastener 120 to ride up and down (e.g. slide freely) within slot 126 as the blade segment 106 moves relative to the backing plate 104.

Sleeve 133 may be made of a strong, high impact material, such as steel. Each fastener 120 engages with a sleeve 133 within a slot 126.

In some embodiments, slots 126 of the blade segment 106 may be co-axial with openings of the retainer plate 105 such that a single fastener 120 can pass through retainer plate 105, an opening of blade segment 106 and be received in a sleeve 133 that is then positioned within slot 126 to slidably mount both blade segment 106 and the retainer plate 105 to the backing plate 104.

Figure 8A:
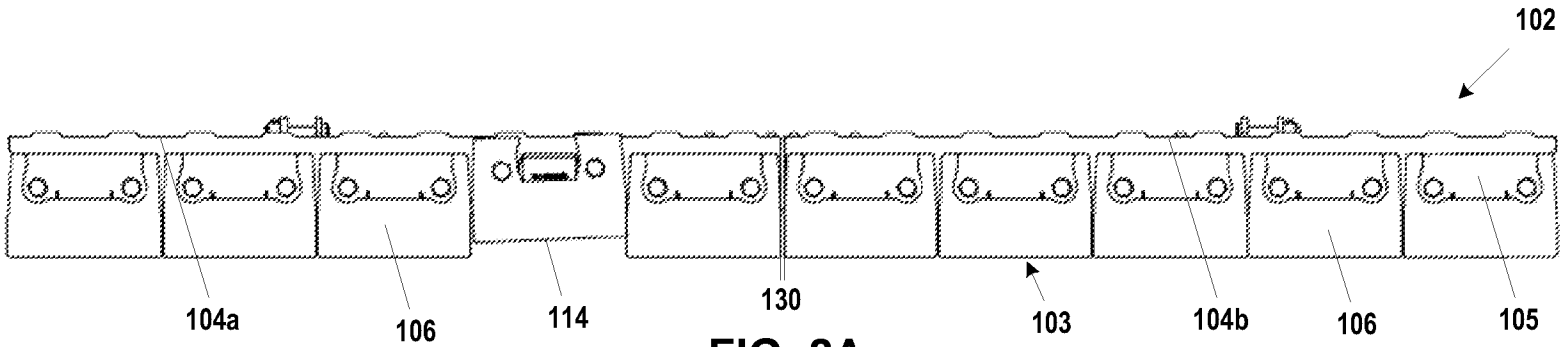
FIG. 8A is a front view of the cutting edge system of FIG. 3 showing a blade segment thereof at a first angled position.
Figure 8B:
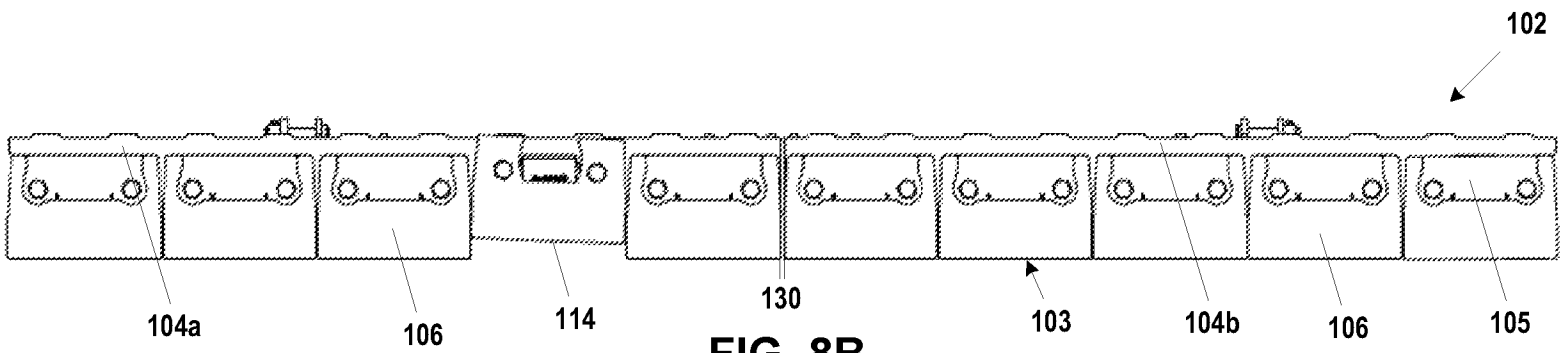
FIG. 8B is a front view of the cutting edge system of FIG. 3 showing a blade segment thereof at a second angled position.

Referring to FIGS. 8A and 8B, each blade segment 106 is spaced from an adjacent blade segment 106 by a spacing 130 (see FIG. 8A). Spacing 130 together with at least a portion of each slot 126 being wider than a width of the fastener 120 and sleeve 133 provides for the cutting edge 114 of each blade segment 106 to slightly pivot horizontally about an axis extending in the direction of travel of the snowplow blade 100 to further provide for the blade segment 106 to conform to a ground surface as the snowplow blade 100 is pushed along the ground surface. In some embodiments, spacing 130 together with at least a portion of each slot 126 being wider than a width of the fastener 120 and sleeve 133 may provide for the cutting edge 114 of blade segment 106 to pivot horizontally. Horizontal pivoting of the cutting edge may be, for example, up to a pivot. In some embodiments, the pivot angle may be about 5 degrees. In other embodiments, the pivot angle may be greater than about 5 degrees or less than about 5 degrees. Adjacent blade segments 106 being able to horizontally pivot independently of each other may provide for adjacent corners of each cutting edge 114 to contact each other when the cutting edges 114 are engaging uneven surfaces. For particularly uneven surfaces, independent horizontal pivoting of blade segments 106 may provide for less ground material (e.g. snow) to escape between adjacent blade segments 106 than conventional snowplows with independently vertically slidable blade segments.

Each cutting edge segments 102 also includes a compression member 108 configured to absorb upward movement of the blade segment 106 when the lower portion 110 of the blade segment 106 is engaging the ground surface. Compression member 108 biases (i.e. provides downward pressure) blade segment 106 to provide for cutting edge 114 to follow a contour of the ground surface. In the figures, compression member 108 is shown as a rubber block having a rectangular shape. It should be understood that compression member 108 may also have a non-rectangular shape, such as but not limited to a square shape, a circular shape, an oblong shape, a triangular shape, or any other geometric shape that provides for compression member 108 to bias blade segment 106 downwardly and to absorb energy from upward movement of blade segment 106.

Compression member 108 is configured to be positioned between upper portion 112 of the blade segment 106 and engaging surface 134 of backing plate 104. In at least one embodiment, retainer plate 105 may include an engaging surface extending rearwardly into pocket 118 of blade segment 106 (not shown in the drawings) and compression member 108 may be positioned between and register with the engaging surface of the retainer plate 105 and engaging surface 134 of backing plate 104.

Engaging surface 134 is a rigid surface and is sized to engage with at least a portion of the compression member 108. Engaging surface 134 is generally an elongate surface that is transverse to an axis of travel of the blade segment 106. Engaging surface 134 limits vertical motion of the compression member 108 when the compression member 108 is acted upon by the blade segment 106. Specifically, engaging surface 134 inhibits vertical movement of the compression member 108 by receiving an upward force from the compression member 108 when the blade segment 106 slides upwardly relative to the backing plate 104 and impacts the compression member 108.

In the embodiments shown in the Figures, the compression member 108 is shaped to be at least partially received inside of pocket 118 of blade segment 106 and engages at least a portion of the blade segment 106.

Compression member 108 may be any appropriate compression member for biasing the blade segment 106 downwards. For instance, in the embodiments shown in the drawings, compression member 108 may be a rubber block. In these embodiments, a hardness of the compression member 108 may vary depending on a number of factors including but not limited to a weight of the snowplow blade and the end use of the snowplow. In some embodiments, the compression members may have a Shore A hardness in a range of about 5 to about 100, or in a range of about 20 to about 70, or in a range of about 35 to about 55, or in a range of about 40 to about 50, or of about 45.

While the applicant's teachings described herein are in conjunction with various embodiments for illustrative purposes, it is not intended that the applicant's teachings be limited to such embodiments as the embodiments described herein are intended to be examples. On the contrary, the applicant's teachings described and illustrated herein encompass various alternatives, modifications, and equivalents, without departing from the embodiments described herein, the general scope of which is defined in the appended claims.

What is claimed is:

1. A cutting edge system for a snowplow blade, the system comprising:

a backing plate coupled to a bottom portion of a moldboard of the snowplow blade; and a plurality of cutting edge segments each configured to be slidably mounted to a front surface of the backing plate;

the backing plate having, for each of the cutting edge segments:

a central opening;

a first slot positioned on a first side of the central opening; and a second slot positioned on a second side of the central opening; and each cutting edge segment comprising:

a blade segment configured to be slidably mounted to the backing plate, the blade segment having:

a lower portion having a cutting edge configured to engage a ground surface, and an upper portion having an uppermost edge opposed to the cutting edge and two upwardly extending lobes spaced apart from each other to define an intermediate pocket portion therebetween, each of the two lobes being configured to receive a fastener to slidably mount the blade segment to the backing plate;

a compression member configured to be retained in between the uppermost edge of the intermediate pocket portion and an engaging surface extending from the central opening of the backing plate, the compression member being configured to absorb upward movement of the blade segment when the cutting edge engages the ground surface;

a retainer plate configured to be slidably mounted to the backing plate and cover at least a portion of the blade segment when the blade segment is mounted to the backing plate; and at least one sleeve positioned rearwardly of the blade segment, each sleeve being configured to receive one of the fasteners, each sleeve being shaped to be received inside one of the slots of the backing plate and slide vertically within the slot when the blade segment moves vertically relative to the backing plate.

2. The cutting edge system of claim 1, wherein the first and second slots of the backing plate are each axially aligned with respective openings of the blade segment to receive the fasteners therethrough to slidably mount the blade segment to the backing plate.

3. The cutting edge system of claim 1, wherein the first and second slots of the backing plate are each axially aligned with respective openings of the retainer plate to receive the fasteners therethrough to slidably mount the retainer plate to the backing plate.

4. The cutting edge system of claim 1, wherein the first and second slots of the backing plate are each axially aligned with respective openings of the blade segment and respective openings of the retainer plate to receive the fasteners therethrough to slidably mount the blade segment and the retainer plate to the backing plate.

5. The cutting edge system of claim 1, wherein the at least one sleeve further extends rearwardly of the backing plate.

6. The cutting edge system of claim 5, wherein the at least one sleeve extends into a respective aperture of the blade segment.

7. The system of claim 1, wherein the slots of the backing plate are spaced apart from each other along a width of the backing plate and each slot has a perimeter that is greater than a perimeter of a respective sleeve.

8. The system of claim 1, wherein each of the two slots has a height that is greater than a height of a respective fastener to provide for sliding, vertical movement of the blade segment relative to the backing plate when the cutting edge engages the ground surface.

9. The system of claim 1, wherein each of the two slots includes a slot extension extending downwardly from the slot, each slot extension having a width that is less than a width of the slot.

10. The system of claim 9, wherein the width of each of the slot extensions is less than a width of a sleeve that is shaped to be received inside one of the slots of the backing plate and slide vertically therein.

11. The system of claim 1, wherein the retainer plate is configured to cover the intermediate pocket portion when the blade segment is mounted to the backing plate.

12. The system of claim 1, wherein the retainer plate is configured to cover the central opening when the blade segment is mounted to the backing plate.

13. The system of claim 1, wherein the engaging surface of the backing plate is parallel to the cutting edge of the blade segment.

14. The system of claim 1, wherein the central opening has a width that is greater than a width of the compression member.

15. A snowplow blade comprising:

a moldboard; and a cutting edge system coupled to the moldboard, the cutting edge system comprising:

a backing plate coupled to a bottom portion of a moldboard of the snowplow blade; and a plurality of cutting edge segments each configured to be slidably mounted to a front surface of the backing plate;

the backing plate having, for each of the cutting edge segments:

a central opening;

a first slot positioned on a first side of the central opening; and a second slot positioned on a second side of the central opening; and each cutting edge segment comprising:

a blade segment configured to be slidably mounted to the backing plate, the blade segment having:

a lower portion having a cutting edge configured to engage a ground surface, and an upper portion having an uppermost edge opposed to the cutting edge and two upwardly extending lobes spaced apart from each other to define an intermediate pocket portion therebetween, each of the two lobes being configured to receive a fastener to slidably mount the blade segment to the backing plate;

a compression member configured to be retained in between the uppermost edge of the intermediate pocket portion and an engaging surface extending from the central opening of the backing plate, the compression member being configured to absorb upward movement of the blade segment when the cutting edge engages the ground surface; and a retainer plate configured to be slidably mounted to the backing plate and cover at least a portion of the blade segment when the blade segment is mounted to the backing plate; and at least one sleeve positioned rearwardly of the blade segment, each sleeve being configured to receive one of the fasteners, each sleeve being shaped to be received inside one of the slots of the backing plate and slide vertically within the slot when the blade segment moves vertically relative to the backing plate.

16. The snowplow blade of claim 15, wherein the first and second slots of the backing plate are each axially aligned with respective openings of the blade segment to receive the fasteners therethrough to slidably mount the blade segment to the backing plate.

17. The snowplow blade of claim 15, wherein the first and second slots of the backing plate are each axially aligned with respective openings of the retainer plate to receive the fasteners therethrough to slidably mount the retainer plate to the backing plate.

18. The snowplow blade of claim 15, wherein each of the two slots has a height that is greater than a height of a respective fastener to provide for sliding, vertical movement of the blade segment relative to the backing plate when the cutting edge engages the ground surface.

19. The snowplow blade of claim 15, wherein each of the two slots includes a slot extension extending downwardly from the slot, each slot extension having a width that is less than a width of the slot.

20. The snowplow blade of claim 15, wherein the at least one sleeve further extends rearwardly of the backing plate.

* * * * *